US009456281B2

(12) United States Patent
Tang

(10) Patent No.: US 9,456,281 B2
(45) Date of Patent: Sep. 27, 2016

(54) MINIATURE SPEAKER

(71) Applicant: Yun Tang, Shenzhen (CN)

(72) Inventor: Yun Tang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/736,852

(22) Filed: Jun. 11, 2015

(65) Prior Publication Data

US 2016/0173988 A1 Jun. 16, 2016

(30) Foreign Application Priority Data

Dec. 11, 2014 (CN) ..... 2014 2 0779923 U

(51) Int. Cl.
*H04R 9/02* (2006.01)

(52) U.S. Cl.
CPC ..... *H04R 9/025* (2013.01); *H04R 2499/11* (2013.01)

(58) Field of Classification Search
CPC ..... H04R 9/00; H04R 9/02; H04R 9/06; H04R 9/025; H04R 9/041; H04R 9/045; H04R 2209/022; H04R 31/006; H04R 1/00
See application file for complete search history.

(56) References Cited

U.S. PATENT DOCUMENTS

| | | | | |
|---|---|---|---|---|
| 7,020,301 | B2 * | 3/2006 | Koura | H04R 7/04 381/399 |
| 2009/0147972 | A1 * | 6/2009 | Hwang | H04R 19/02 381/190 |
| 2009/0316937 | A1 * | 12/2009 | Zheng | H04R 19/00 381/182 |
| 2011/0194723 | A1 * | 8/2011 | Lin | H04R 13/00 381/396 |
| 2012/0294474 | A1 * | 11/2012 | Wu | H02K 35/02 381/400 |

* cited by examiner

*Primary Examiner* — Matthew Eason
(74) *Attorney, Agent, or Firm* — Na Xu; IPro, PLLC

(57) ABSTRACT

A miniature speaker includes a frame having a sidewall including a first upper thinner portion and a first lower thicker portion, a magnetic circuit unit, a voice coil having a lead wire, and a diaphragm driven by the voice coil. The magnetic circuit unit has a yoke, a magnet mounted on the yoke, a pole plate attached to the magnet, and a magnetic gap. The yoke further includes a lower plate and a side extending from the lower plate, the side including a second thinner portion and a second lower thicker portion. A recess is accordingly formed by the thinner portions and the thicker portions for accommodating the lead wire of the voice coil. The recess defines a bottom formed by the thicker portions and an opening formed by the thinner portions thereby providing an enlarged space to the lead wire.

8 Claims, 2 Drawing Sheets

MINIATURE SPEAKER

FIELD OF THE INVENTION

The present invention relates to electro-acoustic transducers, more particularly to a miniature speaker used in an electronic device.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a miniature speaker related to the present disclosure electrically connects to external circuits via elastic contacts. Such a miniature speaker includes a frame, a sound generator accommodated in the frame, and contacts positioned by the frame. The sound generator includes a magnetic circuit unit having a magnetic gap, a diaphragm, and a voice coil partially received in the magnetic gap and driving the diaphragm to vibrate. The voice coil is configured to receive corresponding electrical signals from the external circuit via the elastic contacts by electrically connecting leads wires thereof to the contacts. The magnetic field in the magnetic gap is normally non-linear, which cause the vibration of the voice coil to be also non-linear, and further makes the sound produced by the speaker have non-linear distortion.

Accordingly, an improved miniature speaker which can overcome the disadvantages described above is desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
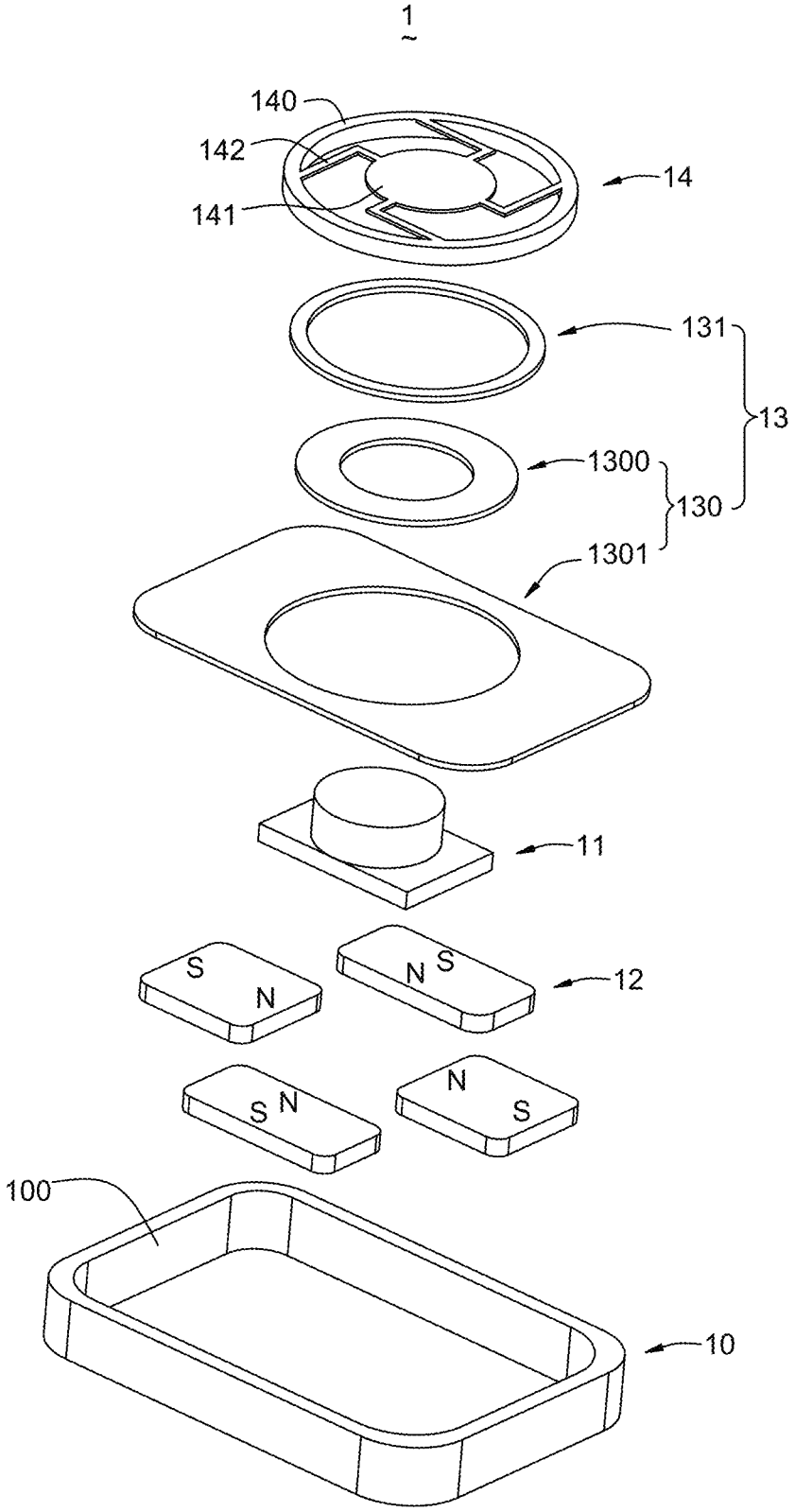
FIG. 1 is an isometric exploded view of a miniature speaker in accordance with a first embodiment of the present disclosure.
Figure 2:
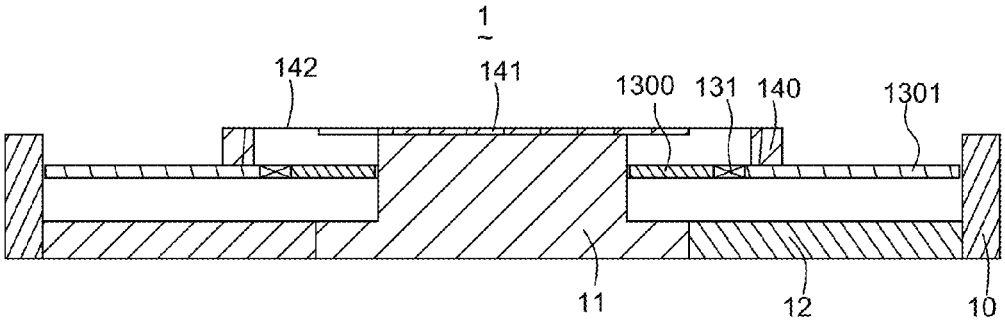
FIG. 2 is a cross-sectional view of the miniature speaker in FIG. 1.

Referring to FIGS. 1-2, a miniature speaker 1 in accordance with a first embodiment of the disclosure includes a yoke 10 having a yoke side 100, a magnetic conduction member 11 positioned in the yoke 10 and keeping a distance from the yoke side 100, a magnet 12 positioned by the yoke 10 and locating between the yoke side 100 and the magnetic conduction member 11, a magnetic conduction membrane 13 locating between the magnetic conduction member 11 and the yoke side 100, an elastic frame 14 for suspending the magnetic conduction membrane 13 in a gap formed by the yoke side 100 and the magnetic conduction member 11. A connecting line from the North Pole to the South Pole of the magnet 12 is perpendicular to the yoke side 100, and the magnetic conduction membrane 13 is movable in the gap formed by the magnetic conduction member 11 and the yoke side 100.

The magnetic conduction membrane 13 includes a pole plate 130 made from magnetic conduction material, and a driving coil 131 positioned by the pole plate 130. In a direction perpendicular to the yoke side 100, the driving coil 131 at least partially overlaps the pole plate 130. The magnet 12, the magnetic conduction member 11, the magnetic conduction membrane 13 and the yoke 10 cooperatively form a closed magnetic loop.

The magnet 12, the magnetic conduction member 11, the magnetic conduction membrane 13 and the yoke 10 cooperatively form a closed magnetic loop in order to forces almost all the magnetic field lines produced by the magnet 12 to go through the magnetic conduction membrane 13, which is obviously different form the conventional miniature speaker. During the vibration of the driving coil 131, the magnetic field lines through the driving coil 131 will not change because the driving coil 131 is positioned by the pole plate 130 and the pole plate 130 will move simultaneously with the driving coil 131. Another word, the magnetic field lines going through the driving coil 131 is constant, which distinctly optimizes the non-linear distortion of the miniature speaker.

The elastic frame 14 may be designed and configured according to actual requirements, as long as the elastic frame 14 is capable of suspending the magnetic conduction membrane 13 in the gap formed by the yoke side 100 and the magnetic conduction member 11. Further, the elastic frame 14 should ensure that the magnetic conduction membrane 13 do not contact the yoke 10 or the magnetic conduction member 11. In this embodiment, the elastic frame 14 includes a first ring-shaped positioning portion 140 connecting to the magnetic conduction membrane 13, a second ring-shaped positioning portion 141 connecting to the magnetic conduction member 11, and a plurality of elastic arms 142 connecting the first ring-shaped positioning portion 140 to the second ring-shaped positioning portion 141.

During the vibration of the driving coil 131, the magnetic field lines through the driving coil 131 will not change because the driving coil 131 is positioned by the pole plate 130 and the pole plate 130 will move simultaneously with the driving coil 131. For obtaining better acoustic performance, intervals between the magnetic conduction membrane 13 and the magnetic conduction member 11, and between the magnetic conduction membrane 13 and the yoke side 100 may be sealed by lubricating oil, magnetic fluid, or conventional suspensions.

Regarding the magnetic conduction membrane 13, in this embodiment, the pole plate 130 includes an inner pole plate 1300, an outer pole plate 1301 surrounding the inner pole plate 1300, and a space formed between the inner pole plate 1300 and the outer pole plate 1301 for accommodating the driving coil 131. Another word, the driving coil 131 is sandwiched between the inner pole plate 1300 and the outer pole plate 1301.

Figure 3:
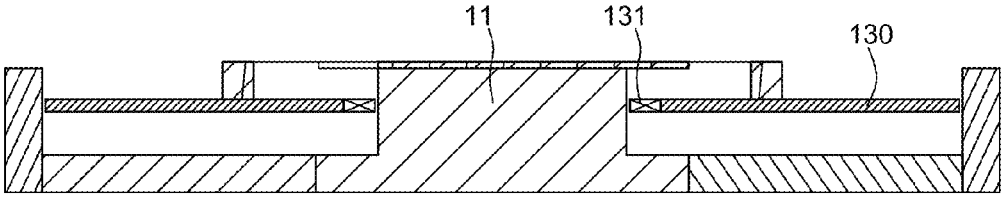
FIG. 3 is a cross-sectional view of a miniature speaker in accordance with a second embodiment of the present disclosure.

Referring to FIG. 3, a second embodiment is shown. What is different from the first embodiment is that the driving coil 131 is positioned at an inner edge of the pole plate 130. Thus, the driving coil 131 is positioned by the pole plate 130 and is located between the pole plate 130 and the magnetic conduction member 11.

Figure 4:
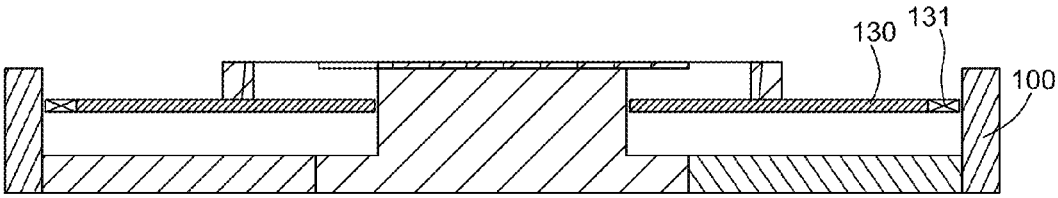
FIG. 4 is a cross-sectional view of a miniature speaker in accordance with a third embodiment of the present disclosure.

Referring to FIG. 4, a third embodiment is shown. What is different from the first embodiment is that the driving coil 131 is positioned at an outer edge of the pole plate 130. Thus, the driving coil 131 is positioned by the pole plate 130 and is located between the pole plate 130 and the yoke side 100.

Regarding the magnet 12, referring to FIG. 1, the magnet 12 may comprises a plurality of sub-magnets surrounding the magnetic conduction member 11, and the ends facing the magnetic conduction member have the same poles. A shown in FIG. 1, all the N Poles face the magnetic conduction member. In fact, alternatively, all the S Poles may also face the magnetic conduction member.

Briefly, because of the driving coil positioned by and overlaps the pole plate, during the vibration of the driving coil, the magnetic field lines through the driving coil will not change, and the pole plate will move simultaneously with the driving coil. Another word, the magnetic field lines going through the driving coil is constant, which distinctly optimizes the non-linear distortion of the miniature speaker.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a yoke having a yoke side;

a magnetic conduction member positioned in the yoke and keeping a distance from the yoke side for forming a gap therebetween;

a magnet positioned by the yoke, and a connecting line from a North Pole thereof to a South Pole thereof being perpendicular to the yoke side;

a magnetic conduction membrane suspended in the gap for being activated to vibrate for generating sounds;

a closed magnetic loop formed by the magnet, the magnetic conduction member, the magnetic conduction membrane and the yoke; wherein the magnetic conduction membrane includes a pole plate and a driving coil positioned by the pole plate, and the driving coil at least partially overlaps the pole plate in a direction perpendicular to the yoke side.

2. The miniature speaker as described in claim 1, wherein the driving coil is positioned at an inner edge of the pole plate, and locates between the pole plate and the magnetic conductive member.

3. The miniature speaker as described in claim 1, wherein the driving coil is positioned at an outer edge of the pole plate, and locates between the pole plate and the yoke side of the yoke.

4. The miniature speaker as described in claim 1, wherein the pole plate includes an inner pole plate and an outer pole plate surrounding the inner pole plate, and the driving coil is sandwiched between the inner pole plate and the outer pole plate.

5. The miniature speaker as described in claim 1 further including an elastic frame for suspending the magnetic conduction membrane in the gap.

6. The miniature speaker as described in claim 5, wherein the elastic frame includes a first ring-shaped positioning portion connected to the magnetic conduction membrane, a second ring-shaped positioning portion connected to the magnetic conduction member, and a plurality of elastic arms connecting the first ring-shaped positioning portion to the second ring-shaped positioning portion.

7. The miniature speaker as described in claim 1, wherein the magnet includes a plurality of sub-magnets, all the ends thereof facing the magnetic conduction member having the same poles.

8. A miniature speaker, comprising:

a frame including a bottom comprising a magnet, a side made of magnetic conduction material, a middle portion positioned at a center of the frame and made of magnetic conduction material, and a gap formed by the middle portion and the side;

a membrane made of magnetic conduction material and suspended in the gap;

a driving coil assembled with the membrane and overlapping the membrane in a direction perpendicular to the side.

* * * * *